US005330189A

United States Patent [19]

Reichow

[11] Patent Number: 5,330,189

[45] Date of Patent: Jul. 19, 1994

[54] GOLF SWING AID

[76] Inventor: James Reichow, 2912 N. 82nd Cir., Brooklyn Park, Minn. 55444

[21] Appl. No.: 74,589

[22] Filed: Jun. 11, 1993

[51] Int. Cl.[5] ..... A63B 69/36

[52] U.S. Cl. ..... 273/186.2; 273/194 R

[58] Field of Search ..... 273/186.2, 194 R, 186.3, 273/187.4

[56] References Cited

U.S. PATENT DOCUMENTS

| | | | |
|---|---|---|---|
| 3,753,564 | 8/1973 | Brandell | 273/186.2 |
| 4,789,160 | 12/1988 | Dollar et al. | 273/186.2 |
| 4,930,787 | 6/1990 | Nobles | 273/186.2 X |
| 5,184,826 | 2/1993 | Hall | 273/186.2 |

*Primary Examiner*—George J. Marlo
*Attorney, Agent, or Firm*—James R. Cwayna

[57] ABSTRACT

A device for use with a golf club which includes a mercury switch controlled which is adjustable with respect to the shaft of the club which will emit an audible sound when the club is swung rearwardly on the backswing when the preadjusted positioning of the mercury switch is obtained. In this manner the user preadjusts the position of the mercury switch controlled circuit such that the sound will be emitted when the proper backswing height is obtained. The backswing height obviously will control the distance that the ball is driven as the player advances his club forwardly into the ball. The sensitivity of the unit allows for presetting the audible emission location to accommodate putting as well as short iron golf shots. The unit includes an electrical circuit powered through a battery source and a sound emitting element all of which are controlled through a mercury switch.

7 Claims, 1 Drawing Sheet

GOLF SWING AID

FEDERAL SPONSORSHIP

This invention is not made under any federally sponsored research and development arrangement nor any other sponsored research and development arrangement which should be noted.

RELATED APPLICATIONS

There are no related applications currently on file in the United States Patent Office with which this application should be considered.

FIELD OF THE INVENTION

This invention relates generally to golf swing aids and more particularly to a golf swing aid which is attachable to the shaft of a golf club and includes an electrical circuit including a source of power, a mercury switch controlled circuit and a sound emitting element to allow a golfer to preset the circuitry such that upon backswing of a club the sound will be emitted when the mercury switch is tripped due to backswing elevation of the club.

SHORT SUMMARY OF THE INVENTION

The invention includes a unit which is attachable to and will normally surround the shaft of a club and which includes an electrical circuit including a source of power, a mercury switch controlled circuit portion and a set of conductors and leads.

The basic circuit including the source of power, sound emitting element and conductors is mounted in a stationary position and the mercury switch and associated leads which connect the switch into the circuit through contact with the conductors is rotationably shiftable with respect to the stationary portion of the circuit such that the activation of the mercury switch is settable to a degree of backswing applied to the club at which preset point, which corresponds to desired forward ball driven distance, the sound emitting element is activated.

With the total adjustability of the unit the unit may be adjusted for not only hitting a short iron shot but also in putting the ball. Obviously the final result of the unit is to assist the golfer in determining how much backswing is required to hit a ball a predetermined distance and to become accustomed to the same.

The uniqueness lies in the circuit positioning adjustability in that the mercury switch will not be tripped until the club has been brought rearwardly in the backswing to sufficiently bring the mercury switch into closing contact with the remainder of the circuitry.

BACKGROUND AND OBJECTS OF THE INVENTION

As is well known to golfers, one of the most difficult shots in golf is that of the approach shot to the green. In many cases this shot must be taken with less than a full backswing and judgeing how much of a backswing to take is the toughest part of the shot. The problem is that each shot still counts as one and as golfers well know, most of the difficulty around the green accounts in their high scoring.

Applicant's device basically is a learning device that is attached to, for example, a pitching wedge or other high iron. The device is provided with an electronic circuit that is adjustable to emit a beeping or other sound at any predetermined height of the backswing. Therefore, through practice, the user can determine just how much backswing it will take to hit a golf ball a predetermined distance. This of course is applicable to the various high irons that are utilized near the green and with practice the golfer can finally determine how much backswing it will take to hit a golf ball any required distance. The device is equally applicable to putting and putters as well as these high irons.

Applicant has searched the prior art as stated in his Prior Art Statement and although various other golf aid and golf swing aid devices are available or at least are recognized as being patented, these devices primarily function on a mechanical, cyntrifigul force concept. They may include signaling devices but they still function as mechanical units.

Applicant's unit includes a source of power, a mercury switch controlled circuit leg communicating or connected to a sound emitting element with of course the sound emitting element also connected to the source of power through another leg of the circuit such that when the mercury switch is tripped through rearward elevation of the club the circuit is completed and sound will be emitted. At this point the golfer knows that he has reached his point of proper backswing to thus hit the golf ball a predetermined distance with his forward swing. The electrical or electronic circuit concept is adjustable such that the mercury switch controlling the circuit is displaceable from an inoperative position to a position wherein the club in its backswing will at the most be at a ground level position. This should be the ultimate backswing position to accomplish the required distance. The device is obviously not utilized for long distance driving or the like as only this backswing level position is accommodated.

It is therefore an object of the applicant's invention to provide a golf swing aid particularly arranged and constructed to indicate the amount of backswing taken by the golfer to achieve a desired forward driving distance for the ball.

It is a further object of the applicant's invention to provide a golf swing aid removeably attachable to a golf club and including a mercury switch controlled electrical circuit which is adjustable with respect to the axis of the shaft of the club and which includes a source of power and a noise emitting element such as this club is elevated through the backswing upon achieving the preset point of backswing, the circuit will be closed and a sound will be emitted to indicate that the proper height of backswing has been obtained.

It is still a further object of the applicant's invention to provide a golf swing aid which includes a positionable mercury switch controlled electrical circuit which includes a mercury switch with appropriate leads and conductors arranged in one leg of a circuit which controls a sound emitting member primarily for backswing indication wherein the club is brought in its backswing to the point of sound emission which will indicate to the golfer that with such a height of backswing his forward swing will drive the ball a predetermined distance.

These and other objects and advantages of the invention will more fully appear from a consideration of the accompanying disclosure and drawings.

DESCRIPTION OF A PREFERRED FORM OF THE INVENTION

Figure 2:
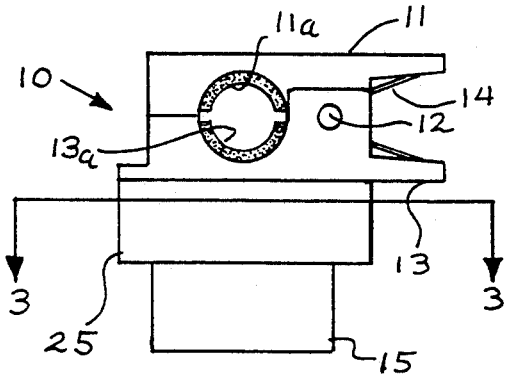
FIG. 2 is a top plan view of the golf swing aid.
Figure 4:
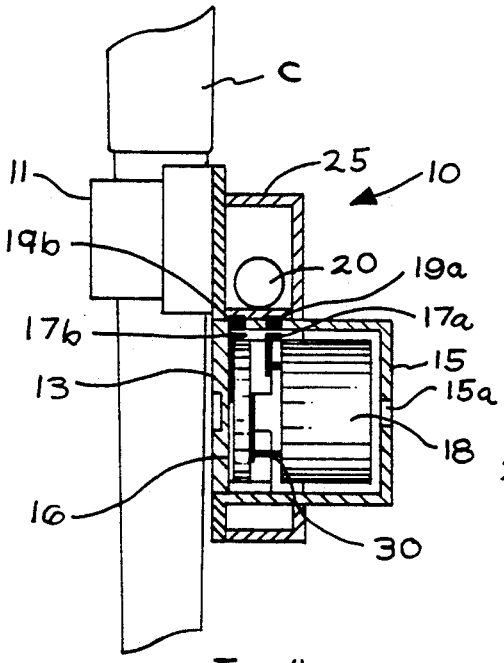
FIG. 4 is a vertical section taken substantially along Line 4—4 of FIG. 3.

In accordance with the accompanying drawings, the applicant's golf swing aid is generally designated in its entirety 10, and for mounting the same onto a golf club shaft a spring loaded pivotal two part clamp is provided. The clamp consists of a rear clamp element 11 having a cushioning section 11*a* arranged interiorly thereof for positive positioning against the round shaft of a golf club C which element 11 is pivotally connected through pin 12 to the electrical circuit housing plate 13 which serves as the frontal clamp element and which is again provided with a cushioning element 13*a* interiorly thereof such that the two elements 11, 13 will close about the shaft of the club C with the cushioning elements 11*a*, 13*a* providing a positive holding friction arrangement such that the unit 10 will not turn upon the shaft of the club. As illustrated in FIG. 2, a spring element 14 is arranged between extensions of the rear element 11 and front plate 13 to apply closure spring force against such elements 11, 13. The two units 11, 13 then provide a simple clamping arrangement for securing the unit to the shaft of a club C.

Arranged on and secured to frontal plate 13 is a housing 15 which houses the electrical circuit elements consisting of the power source 16 conductors 17*a*, 17*b* and the sound emitting element 18. The housing 15 is provided with a sound emitting passage 15*a* and similarly the sound emitting element 18 is provided with a passage 18*a* therethrough.

Figure 3:
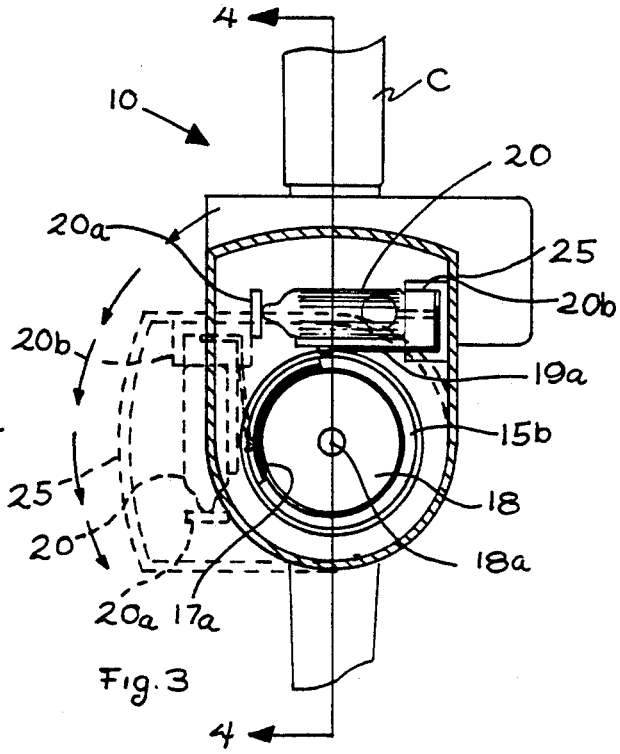
FIG. 3 is a view taken substantially along Line 3—3 of FIG. 2 and illustrating, in solid lines, the mercury switch containing portion of the electrical circuit in an "off" position and in dotted lines, the ultimate position to which this portion of the electrical circuit can be shifted.

As best illustrated in FIG. 3, a portion 15*b* of housing 15 which extends forwardly from plate 13 provides an "off" position for the leads 19*a*, 19*b* to the mercury switch 20. As also illustrated in FIG. 3, this portion 15*b* provides an area in which conductors 17*a*, 17*b* are available for contact with mercury switch leads 19*a*, 19*b* and thus mercury switch 20.

Mercury switch 20 and leads 19*a*, 19*b* are arranged within a rotatable housing 25. Mercury switch 20 is captured within such housing through a pair of end contact members 20*a*, 20*b* and the leads 19*a*, 19*b* contact the mercury switch 20 through end 20*b*. Obviously, ;means must be provided to maintain housing 25 in proper, rotatable position with respect to housing 15 and thus to the conductors 17*a*, 17*b* of the circuit. The leads 19*a*, 19*b* must obviously ride upon such conductors for proper circuit completion.

As illustrated in the solid and dotted lines of FIG. 3, housing 25 and thus the carried mercury switch 20 and leads 19*a*, 19*b* are shiftable in a counterclockwise direction from a position of being in alignment with club C shaft to a position normal to the shaft and this normal to the shaft position will correspond to a backswing position wherein the club C is level with the or parallel to the ground. In the aligned portion the leads 17*a*, 17*b* are resting upon housing portion 15*b* and when the housing 25 is rotated even slightly, as in putting, the leads 17*a*, 17*b* will come into electrical contact with conductors 19*a*, 19*b* at which time the mercury switch 20 will come into circuit control condition.

At this offset location, backswing of the club will result in tripping of the mercury Switch 20 and sound will be emitted from sound element 18. At this point the golfer will stop his backswing and will bring the club C forwardly to strike the ball. Obviously, as this unit is a training device, practice will be required for proper instructional operation.

Figure 1:
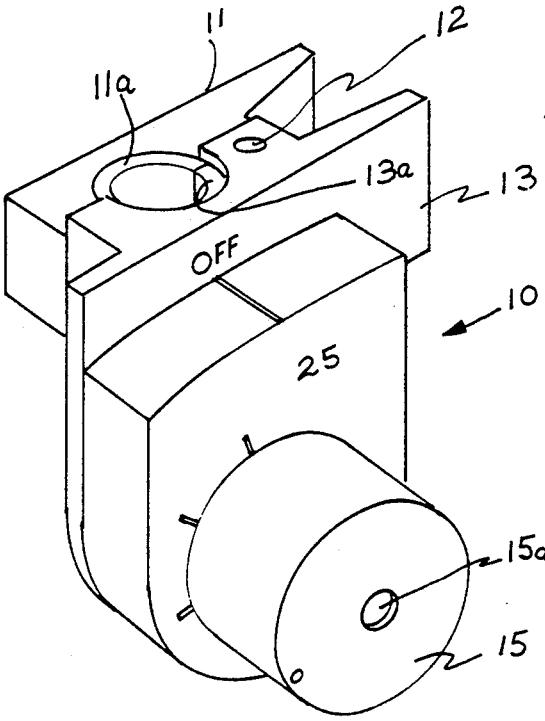
FIG. 1 is a perspective view of the golf swing aid embodying the concepts of the applicant's invention.
Figure 5:
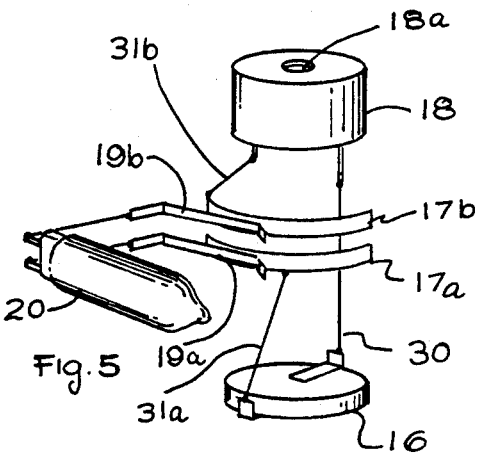
FIG. 5 is a perspective illustration which simply shows the entire electrical circuit including the power source, the mercury switchg the sound emitting element and the conductors and switch leads to complete the circuiut.

The electrical circuitry of the unit is illustrated in FIG. 5. Power source, in the form of a battery 16 has leg 30 directly to the sound emitting element 18. The other leg of the circuit includes a connection 31*a* to a first 17*a* of the conductors with the second 17*b* of the conductors being connected to the sound emitting element 18 through connector 3l*b*. The mercury switch 20 is brought into the circuit through connection thereof to the leads 19*a*, 19*b*. As should be obvious, closure of the mercury switch 20 results in circuit closure and thus sound emission from sound element 18.

It should be obvious that the applicant has provided a new and unique golf swing aid that relies on the development and control of backswing which is the basis for amount of forward, ball driving swing which includes a settable switching arrangment for indicating amount of backswing.

What is claimed is:

1. A golf swing aid, particularly arranged and constructed for height of backswing indication whereby forward distance travel of the ball on forward swing of the club results in proportion to the backswing, said aid including:

a. clamp means for mounting the aid onto the shaft of a golf club;

b. said clamp means including a rear clamp and a forward clamp;

c. a first housing arranged on said forward clamp and housing at least selected portions of a sound emitting electrical circuit including a source of power, electrical conductors and a sound emitting element; and, d. a second housing arranged for rotation about said first housing and including a mercury switch and leads extending between said conductors and said mercury switch whereby the tripping position of said mercury switch may be modified to control the amount of backswing required to complete the electrical circuit and excite said sound emitting element.

2. The golf swing aid as set forth in claim 1 and said first housing including non-conducting portion, said second housing being shiftable to locate the leads of said mercury switch thereon whereby an non-functioning, off position is provided.

3. The golf swing aid as set forth in claim 1 and said electrical, sound emitting circuitry including:

a. a connector line from said source of power to said noise emitting element;

b. a pair of conductors;

c. a connector from said power source to a first of said conductors and a connector from said second conductor to said noise emitting element; and, d. said mercury switch being arranged between and electrically connected to said conductors, whereby actuation of said mercury switch through backswing shifting of the club will energize said noise emitting element.

4. The golf swing aid as set forth in claim 3 wherein said second housing is shiftable from a first, off, position in alignment with the axis of the club through positions to bring the same into normal relation to the axis of the club.

5. The golf swing aid as set forth in claim 3 and a pair of conductive leads electrically connecting said mercury switch to said conductors.

6. The golf swing aid as set forth in claim 1 and said first housing having a sound passing opening therein.

7. The golf swing aid as set forth in claim 1 and said sound emitting element having a passage therethrough.

* * * * *